US010145060B1

(12) United States Patent
Jules

(10) Patent No.: US 10,145,060 B1
(45) Date of Patent: Dec. 4, 2018

(54) PORTABLE RECHARGEABLE IRON

(71) Applicant: Saul Jules, Albertville, AL (US)

(72) Inventor: Saul Jules, Albertville, AL (US)

( * ) Notice: Subject to any disclaimer, the term of this patent is extended or adjusted under 35 U.S.C. 154(b) by 0 days.

(21) Appl. No.: 15/875,741

(22) Filed: Jan. 19, 2018

(51) Int. Cl.
*H01M 4/36* (2006.01)
*D06F 75/16* (2006.01)
*D06F 75/34* (2006.01)

(52) U.S. Cl.
CPC ..... *D06F 75/16* (2013.01); *D06F 75/34* (2013.01)

(58) Field of Classification Search
CPC ..... D06F 75/16; D06F 75/34; D06F 75/00; D06F 75/08; D06F 73/00
See application file for complete search history.

(56) References Cited

U.S. PATENT DOCUMENTS 3,168,641 A 2/1965 Hanusiak
2008/0052970 A1* 3/2008 Lee ..... D06F 75/00 38/75
2009/0313767 A1 12/2009 Tanner et al.
2016/0340823 A1* 11/2016 Herrild ..... D06F 75/08

* cited by examiner

*Primary Examiner* — Jane J Rhee
(74) *Attorney, Agent, or Firm* — Dale J. Ream

(57) ABSTRACT

A rechargeable clothing iron includes an iron body member defining an interior area and a battery assembly positioned therein, the battery assembly being movable between a deployed configuration operatively coupled to the iron body and a removed configuration displaced from the interior area. The battery assembly includes a battery electrically connected to current terminals in the interior area of the iron body member when the battery assembly is in the deployed configuration. A handle is coupled to the battery by which the battery is selectively movable to the extended configuration. A steam generation assembly includes a water reservoir and a heating element, the steam generation assembly being electrically connected to the battery assembly when the battery assembly is in the deployed configuration. A heat plate is fixedly attached to a bottom surface of the iron body and electrically connected to the heating element.

5 Claims, 8 Drawing Sheets

PORTABLE RECHARGEABLE IRON

BACKGROUND OF THE INVENTION

This invention relates generally to steam-activated irons for straightening clothing and, more particularly, to an iron having a rechargeable battery so that the iron is both portable and usable when traditional A/C power is not available.

A clothing iron is a generally triangular surface that, when heated, is effective to press clothing and to remove creases therefrom. The weight of the iron and the heat provide the desired effect. Some irons receive water into a reservoir which is then turned to steam by the heat for even better results in crease removal. Traditionally, the heating element of an iron is powered by AC current via an electric power cord connected to a plug. For this reason, a traditional iron is inoperable when A/C power is not available, when the iron needs to be used in a location that is not proximate an A/C outlet, or in locations where homes may not have consistent access to electricity. To be clear, there are many countries where having electricity is considered a great luxury. Even in the United States, there are areas where electricity is either not available to all residents or where its use must rationed for economic reasons.

Nevertheless, the desire remains to have a clothing iron to remove creases from clothing. Therefore, it would be desirable to have a clothing iron that is battery powered so that creases may be removed from clothing when A/C electricity is not available or accessible. Further, it would be desirable to have a clothing iron in which a battery within *

SUMMARY OF THE INVENTION

A rechargeable clothing iron according to the present invention includes an iron body member defining an interior area and a battery assembly positioned therein, the battery assembly being movable between a deployed configuration operatively coupled to the iron body and a removed configuration displaced from the interior area. The battery assembly includes a battery electrically connected to a pair of current terminals in the interior area of the iron body member when the battery assembly is in the deployed configuration. A handle is coupled to the battery by which the battery is selectively movable to the extended configuration. A steam generation assembly is situated in the interior area that includes a water reservoir and a heating element, the steam generation assembly being electrically connected to the battery assembly when the battery assembly is in the deployed configuration. A heat plate is fixedly attached to a bottom surface of the iron body and electrically connected to the heating element.

Therefore, a general object of this invention is to provide a rechargeable and portable clothing iron uniquely configured to remove creases from clothing even when electricity is not available.

Another object of this invention is to provide a rechargeable and portable clothing iron, as aforesaid, in which the recharageable battery is coupled to the operational handle used for operating the iron.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
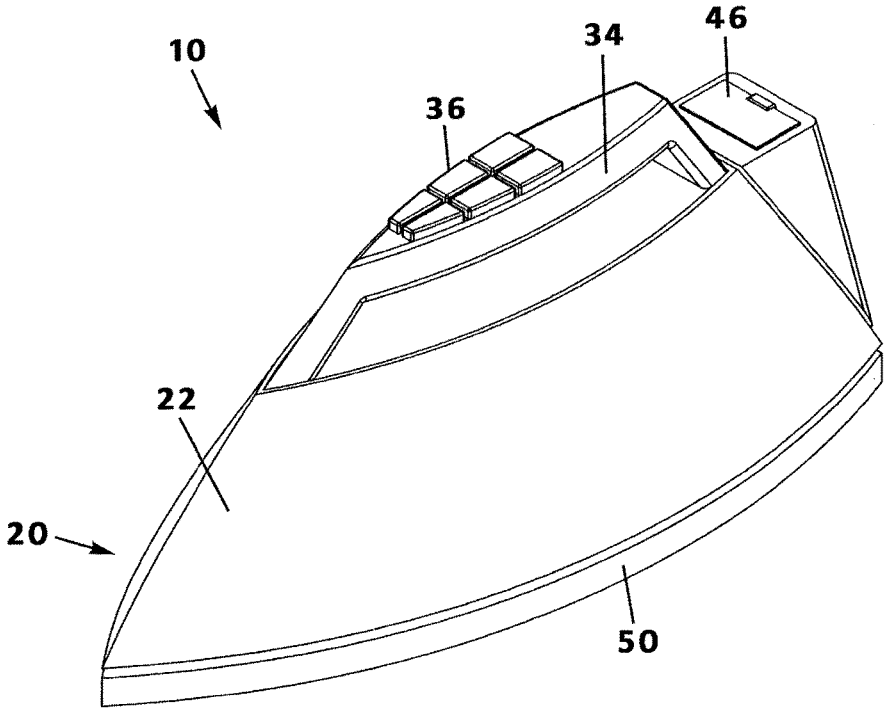
FIG. 1 is a perspective view of a rechargeable clothing iron according to a preferred embodiment of the present invention.

A portable rechargeable clothing iron according to the present invention will now be described in detail with reference to FIGS. 1 to 9 of the accompanying drawings. The portable rechargeable clothing iron 10 includes an iron body member 20, a battery assembly 30 having a battery 32 and handle 34, a steam generation assembly 40, and a heat plate 50.

The iron body member 20 is the main housing of the rechargeable clothing iron 10 and ma0y have a frusto-triangular configuration, i.e. having three sides, such as a pair of side walls 22 and a rear wall 24. A heat plate 50 is a metal plate having a smooth bottom surface, the heat plate 50 being fixedly attached to a bottom or base of iron body member 20.

The iron body member 20 has a roughly triangular base with a pair of mirror image sides extending upwardly form a heat plate 50 and a rear wall 24. The iron body member 20 defines an interior area, an upper portion 25 of which is accessible via an open top and a lower portion 26 of which is internal and defined by the side and rear walls, collectively. An intermediate wall 27 may separate the lower portion 26 from the upper portion 25 of the interior area. A pair of current terminals 28 extends upwardly from the intermediate wall 27 into the upper portion 25 of the interior area.

Figure 5A:
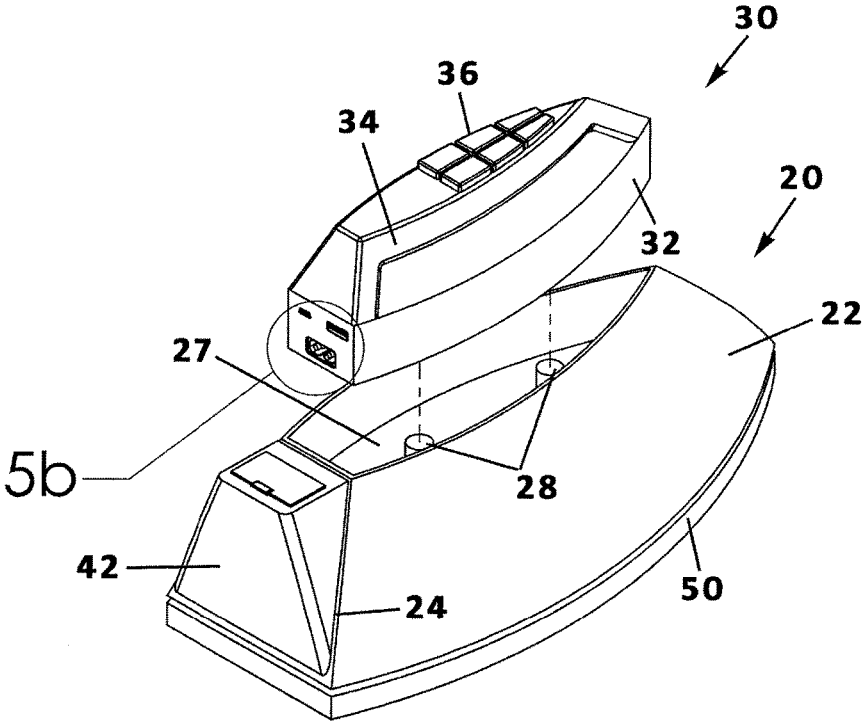
FIG. 5*a* is an exploded view of the clothing iron as in FIG. 1, illustrated from a rear perspective angle.
Figure 5B:
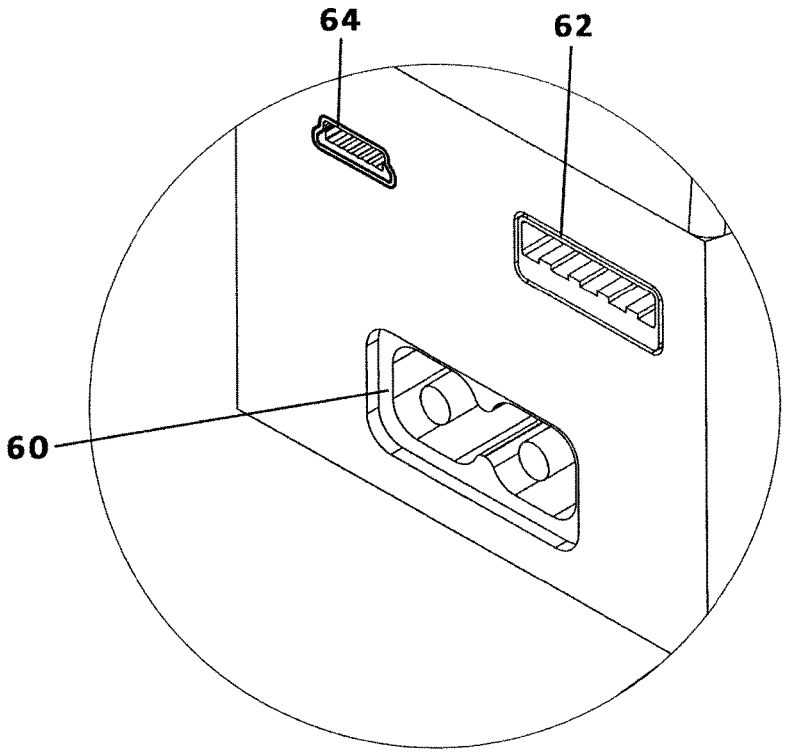
FIG. 5*b* is an isolated view on an enlarged scale taken from FIG. 5*a;*
Figure 6:
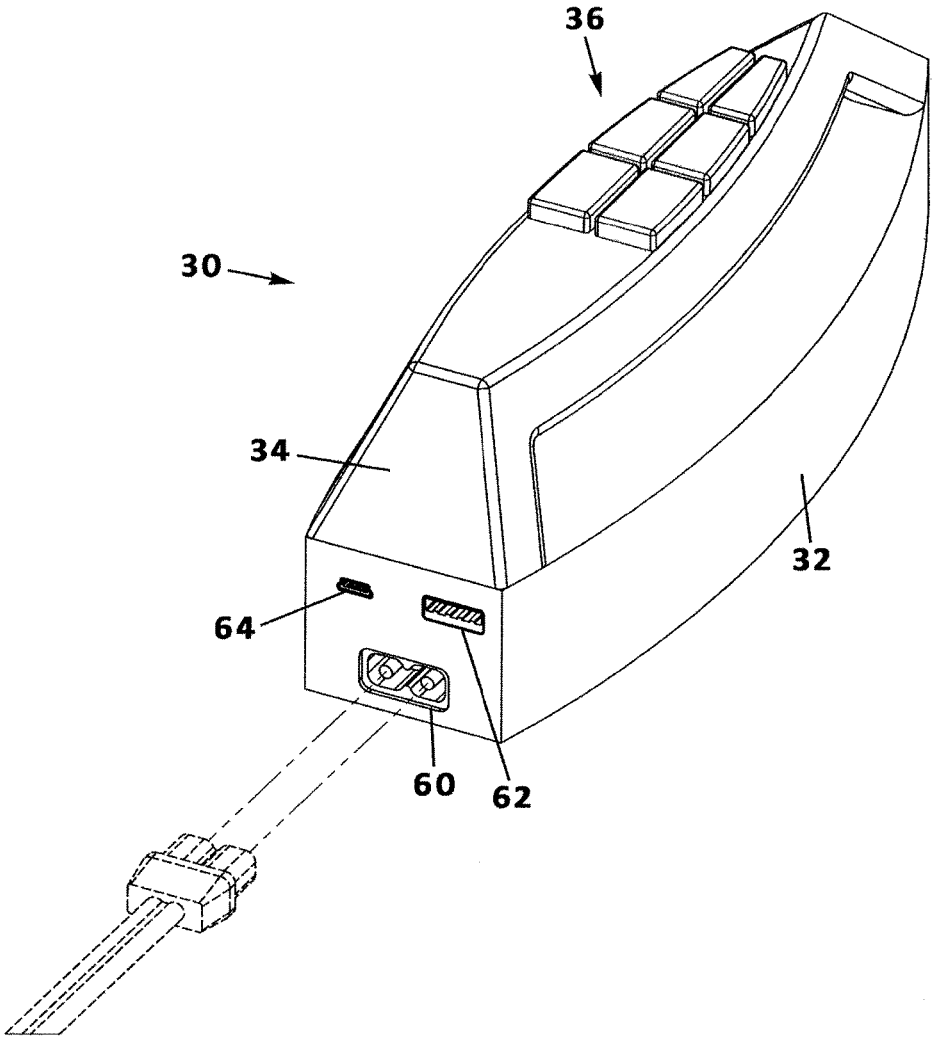
FIG. 6 is an exploded view of the battery assembly removed from the iron body and being connected to an external power source.
Figure 7A:
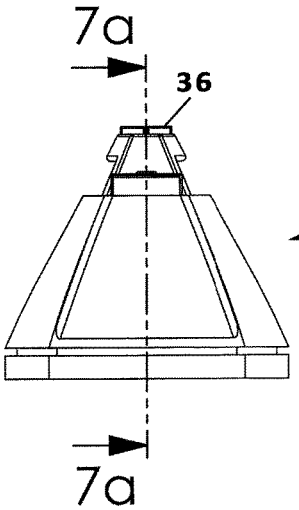
FIG. 7*a* is an end view of the battery assembly as in FIG. 6
Figure 7B:
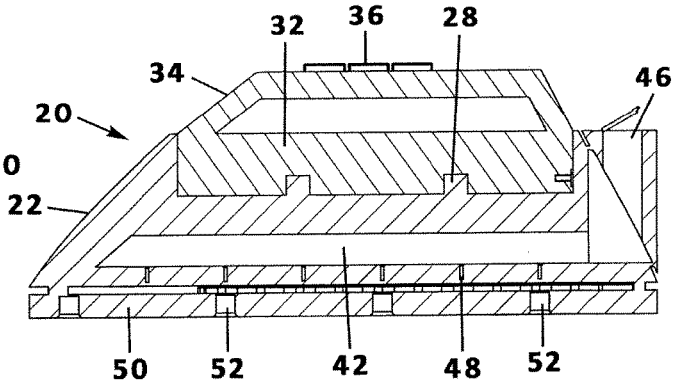
FIG. 7*b* is a sectional view taken along line 7*b*-7*b* of FIG. 7*a;*
Figure 8A:
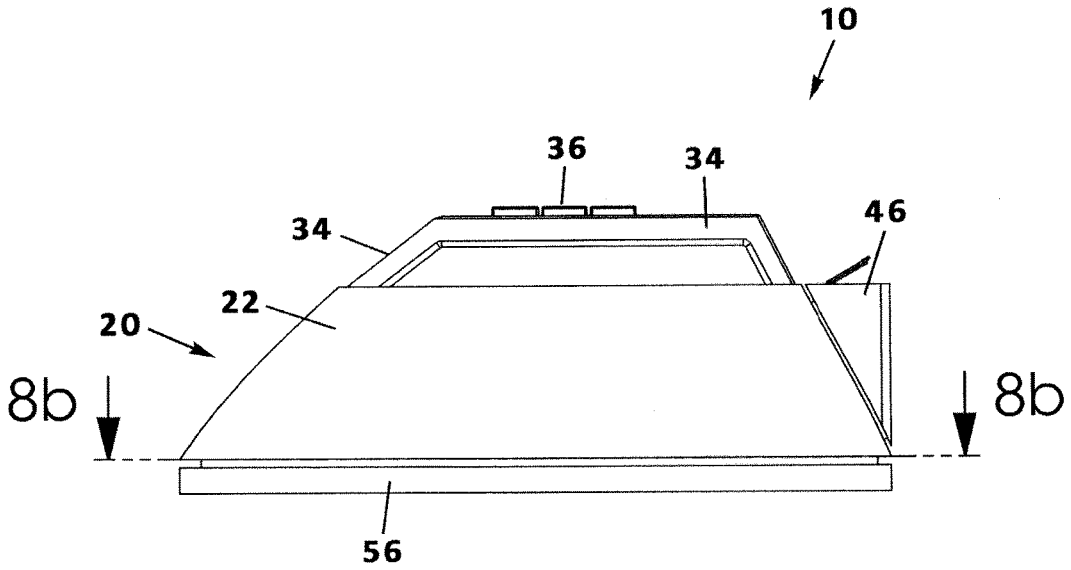
FIG. 8*a* is a side view of the clothing iron as in FIG. 1.
Figure 8B:
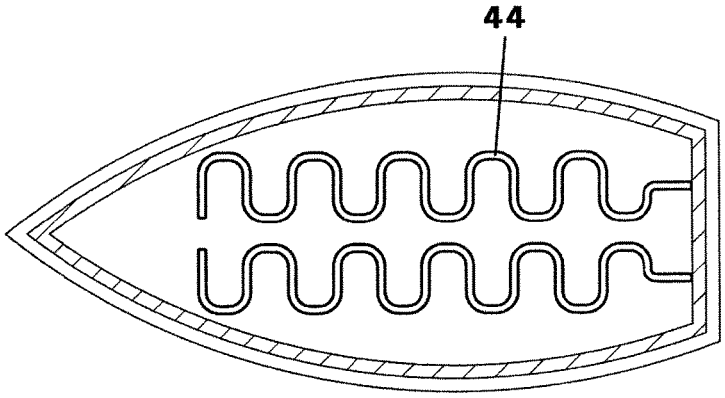
FIG. 8*b* is a sectional view taken along line 8*b*-8*b* of FIG. 8*a*.
Figure 9:
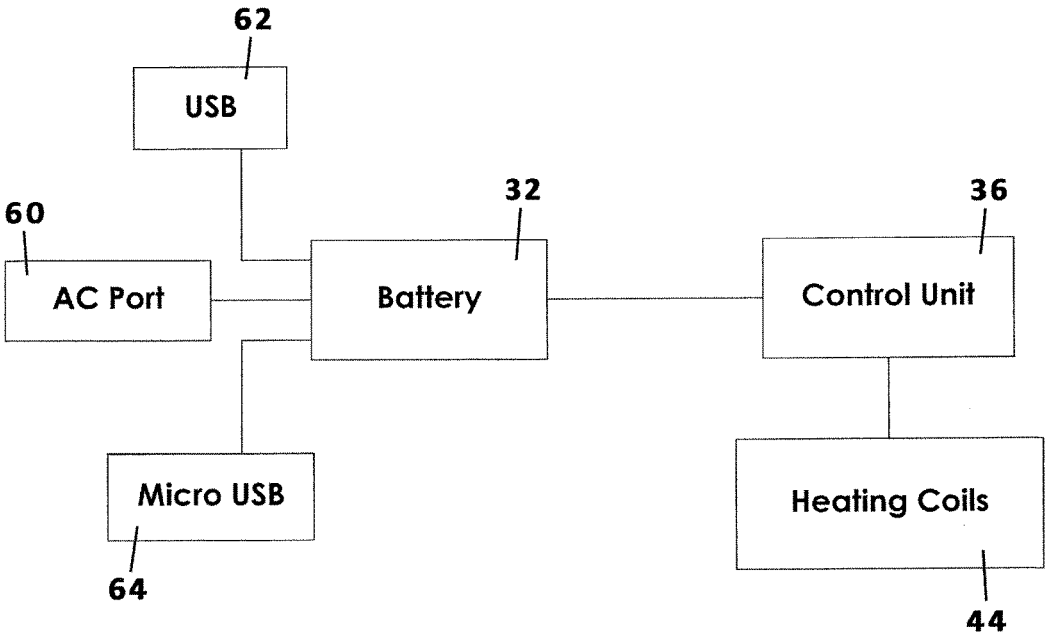
FIG. 9 is a block diagram illustrating the electric and electronic components of the preferred embodiment of the present invention.

The battery assembly 30 includes a rechargeable battery 32 and a handle 34 coupled to the battery 32 and extending upwardly therefrom. The battery 32 of the battery assembly 30 has a shape configuration complementary to a shape configuration of the upper portion 25 of the interior area. The battery 32 may be removably positioned in the upper portion 25 of the interior area and is receivable therein in a nested and friction fit relationship. The battery 32 is removable by a user lifting upwardly on the handle 34 with sufficient force to overcome the friction fit. In an embodiment (not shown), a release button or fastener may be actuated before release and removal is allowed. Stated another way, the battery assembly 30 is movable between a deployed or operation configuration in which the battery is nested in the interior area (FIG. 1) and an extended or removed configuration in which the battery assembly 30 is lifted or displaced from the iron body member 20 (FIG. 5*a*). The handle 34 extends upwardly above the top of the iron body member 20 when the battery 32 is nested in the interior area.

The battery 32 includes receiver channels in a bottom thereof that mate with the pair of current terminals 28 extending upwardly from the intermediate wall 27. This is the structure that allows current to flow from the battery 32 to the steam generation assembly 40 and heating element 46 (FIG. 7*b*) as will be described in more detail below.

Figure 2:
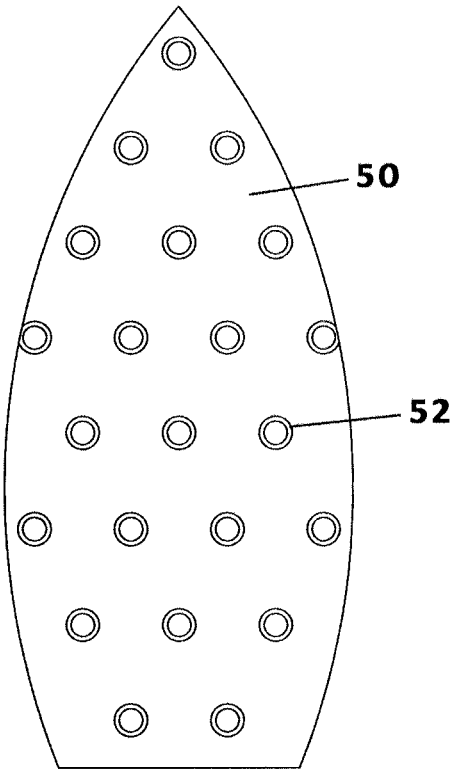
FIG. 2 is a bottom view of the clothing iron as in FIG. 1.
Figure 3:
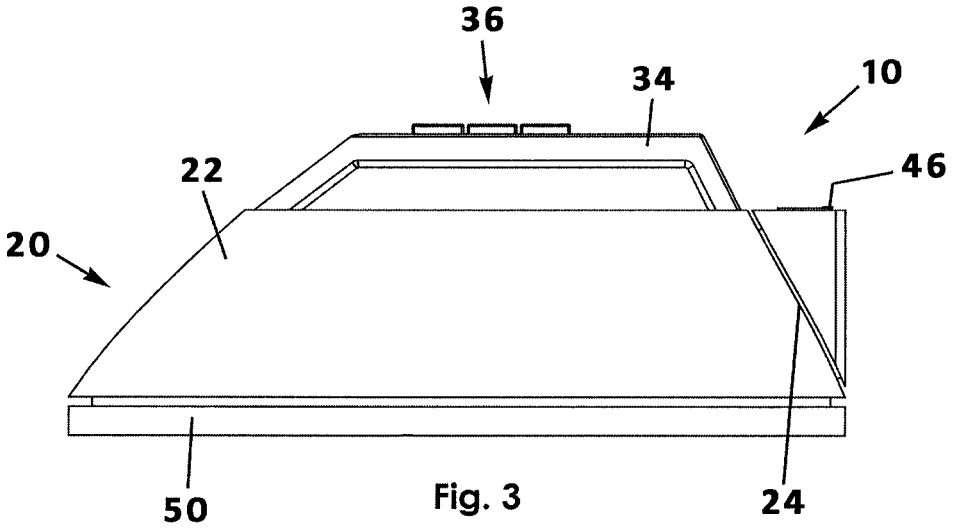
FIG. 3 is a side view of the clothing iron as in FIG. 2.
Figure 4:
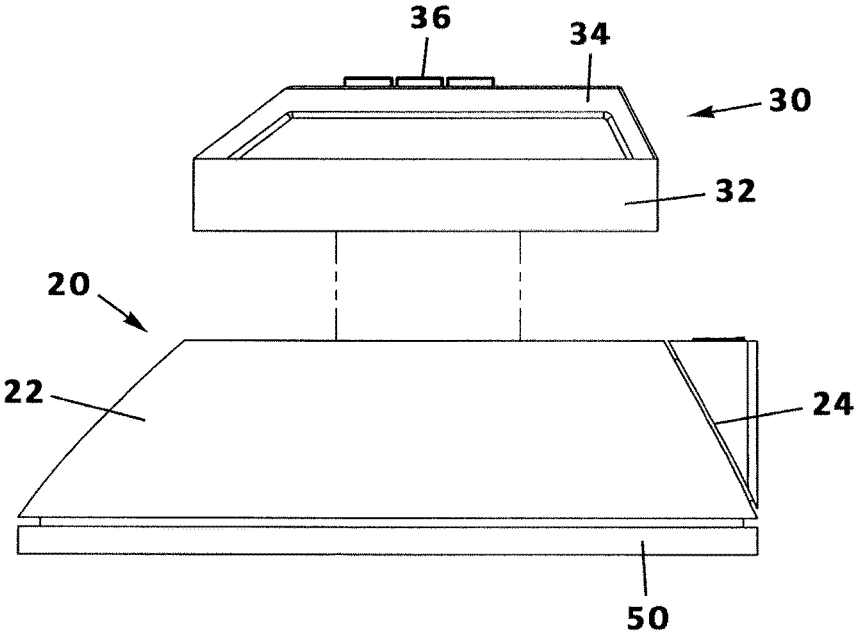
FIG. 4 is an exploded view of the clothing iron as in FIG. 3.

The portable rechargeable clothing iron 10 includes a steam generation assembly 40 having a water reservoir 42 and a heating element 46. More particularly, the water reservoir 42 includes an interior space inside the lower portion 26 of the interior area of the iron body member 20, the interior space being sandwiched between the intermediate wall 27 and the heating element 46 and extending substantially between a front end and rear end thereof. The water reservoir 42 includes an inlet 46 adjacent a rear end of the iron body member 20 through which water may be added to the reservoir 42. A plurality of channels 48 may be in fluid communication with the water reservoir and with or passing adjacent to the heating element 46 (so that the water temperature is increased and the water is turned to steam). The heating element 46 may be a plurality of electric heating coils that may be powered by the battery 32 via suitable circuitry. The heat plate 50 may include a plurality of apertures 52 in fluid communication with the channels 48 of the water reservoir 42 to selectively allow steam to pass from the heat plate 50 (FIG. 2).

The battery 32 is rechargeable via multiple sources of external current. It is understood that the electrical ports described herein may be mounted in respective wall of the iron body member 20. Specifically, the rechargeable clothing iron 10 may include an electrical port that is an A/C power plug-in receiver 60 that is configured to mate with a traditional A/C cable connector end (not shown). In addition, the electrical port may include a USB (universal serial bus) port 62 configured to receive a USB cable end (not shown). Still further, the electrical port may include a micro-USB port 66 configured to receive a micro-USB cable end (not shown). Accordingly, the battery 32 may be recharged using whatever source of electrical current may be available at a given time, such as traditional wall current, current from a battery-backup or charging station, from another piece of electronics such as a personal or laptop computer, or the like.

Operation of the clothing iron 10 is accomplished via a control module 36 mounted to the handle 34. The control module 36 may include one or several control buttons that are electrically connected to the operational components described above, such as by circuitry, wiring, wireless technology, or the like. For instance, respective buttons are electrically connected to the steam generation assembly 40, heat plate 50, battery release components, or the like. The buttons may enable such components to be energized by the battery 32 as will be understood by those of ordinary skill in the art of clothing irons.

In use, the rechargeable battery 32 may be charged fully by plugging an external source of current into respect electrical ports described above. Then, the clothing iron 10 may be unplugged and moved easily to a place of storage or to where it will be needed for ironing clothing. Then, the clothing iron 10 may be used to press or crease clothing using solely current from the battery 32. At any time, the battery 32 may be removed from the iron body by pulling upwardly on the handle 34. Thus, the battery 32 may be transferred to and used with other iron bodies or even other appropriately configured electronic devices.

It is understood that while certain forms of this invention have been illustrated and described, it is not limited thereto except insofar as such limitations are included in the following claims and allowable functional equivalents thereof.

The invention claimed is:

1. A rechargeable clothing iron, comprising:

an iron body member having a housing that includes a bottom surface and a pair of side walls and a rear wall extending upwardly from the bottom surface that, together form a frusto-triangular configuration and defining an interior area;

wherein said pair of side walls and said rear walls of said housing include upper edges, respectively, so that said housing of said iron body member has an open top enabling access into said interior area;

a battery assembly removably operably coupled to said iron body member and movable between a deployed configuration operatively coupled to said iron body so as to block access to said interior area and a removed configuration displaced from said interior area so as to enable access to said interior area, said battery assembly comprising;

a pair of current terminals in said interior area of said iron body member;

a battery electrically connected to said pair of current terminals when said battery assembly is in said deployed configuration;

a handle coupled to said battery by which said battery is selectively movable to said removed configuration, said handle having a pair of opposed end walls extending upwardly from said battery and an upper wall extending between said opposed end walls and displaced from said battery so as to define a grip space therebetween;

wherein said battery has a configuration that is complementary to a configuration of said interior area such that said battery is received in said interior area in a nested engagement at said deployed configuration;

wherein at said deployed configuration said handle is visible from outside said interior area while said battery is not visible from outside said interior area;

an electrical port in electrical communication with said battery and configured for releasable connection to an external electrical power source for charging said battery;

a steam generation assembly situated in said interior area that includes a water reservoir and a heating element, said steam generation assembly being electrically connected to said battery assembly when said battery assembly is in said deployed configuration;

wherein said water reservoir of said steam generation assembly defines an interior space having an inlet adjacent a rear end of said iron body, said water reservoir extending between a front end and said rear end of said rear end of said iron body and defining a plurality of channels in fluid communication with said heating element;

a heat plate fixedly attached to said bottom surface of said iron body and electrically connected to said heating element, wherein said heating plate defines a plurality of apertures in fluid communication with said steam generation assembly through which steam generated thereby is allowed to pass;

a control module mounted to upper wall of said handle and electrically connected to said heating element of said steam generation assembly, said control module having a plurality of buttons for operation by a user and having circuitry for energizing said heating element.

2. The rechargeable clothing iron as in claim 1, wherein said electrical port is an A/C power plug-in port.

3. The rechargeable clothing iron as in claim 1, wherein said electrical port is a USB port.

4. The rechargeable clothing iron as in claim 1, wherein said electrical port is a micro-USB port.

5. The rechargeable clothing iron as in claim 1, wherein said heating element includes a plurality of heating coils.

* * * * *